United States Patent [19]

Adin

[11] 4,430,420

[45] Feb. 7, 1984

[54] PHOTOTHERMOGRAPHIC ELEMENT AND PROCESS COMPRISING AN AMMONIA OR AMINE RESPONSIVE IMAGING MATERIAL

[75] Inventor: Anthony Adin, Rochester, N.Y.

[73] Assignee: Eastman Kodak Company, Rochester, N.Y.

[21] Appl. No.: 412,443

[22] Filed: Aug. 27, 1982

[51] Int. Cl.[3] ..... G03C 1/02

[52] U.S. Cl. ..... 430/351; 430/554; 430/617; 430/619; 430/620; 430/543; 430/936

[58] Field of Search ..... 430/543,554, 619, 617, 430/936, 620, 351

[56] References Cited

U.S. PATENT DOCUMENTS 4,273,860 6/1981 Adin .

OTHER PUBLICATIONS

Research Disclosure, vol. 185, Sep. 1979, 18535, 18560.
Research Disclosure, vol. 194, Jun. 1980, 19415.
Research Disclosure, vol. 170, Jun. 1978, 17029.
Research Disclosure, vol. 176, Dec. 1978, 17643.

*Primary Examiner*—Won H. Louie, Jr.
*Attorney, Agent, or Firm*—Richard E. Knapp

[57] ABSTRACT

In a photothermographic silver halide material and process for preparing an enhanced silver image, an aminosulfonylhydrazone that is capable of developing an image in the photothermographic material and that is capable, upon oxidation, of releasing an aminosulfinic acid, which, in turn, thermally releases ammonia or amine provides a silver image in the photothermographic material and provides ammonia or amine for activation of an ammonia or amine responsive imaging material. After imagewise exposure of the photothermographic material, a silver image enhanced by an image in the ammonia or amine responsive imaging material is produced by heating the photothermographic material.

23 Claims, No Drawings

PHOTOTHERMOGRAPHIC ELEMENT AND PROCESS COMPRISING AN AMMONIA OR AMINE RESPONSIVE IMAGING MATERIAL

BACKGROUND OF THE INVENTION

1. Field of the Invention

This invention relates to a photothermographic silver halide material and process for producing images by means of an aminosulfonylhydrazone reducing agent and an ammonia or amine responsive imaging material.

2. Description of the State of the Art

Photothermographic materials for producing silver images are known. Photothermographic materials after imagewise exposure are heated to moderately elevated temperatures without the need for processing solutions or baths to provide a developed image. It has been desirable to produce an image in such materials that requires reduced concentrations of silver halide. This can be done by producing a silver image that is enhanced by a dye image.

Photothermographic materials that produce a silver image and a dye image are known. Such materials are described in, for example, *Research Disclosure,* Vol. 185, September, 1979, Item No. 18560 and *Research Disclosure,* Vol. 194, June, 1980, Item No. 19415. These materials can comprise hydrazone silver halide developing agents. These hydrazone developing agents have produced dye images in photothermographic materials by coupling reactions, but have not participated in dye formation by releasing a moiety that activates dye formation. The present invention avoids the need for a means separate from the hydrazone developing agent to release ammonia or an amine that activates dye formation.

The term "photothermographic material" herein means a photothermographic element and photothermographic composition.

SUMMARY OF THE INVENTION

It has been found that in a photothermographic material comprising, in reactive association, photographic silver halide, a dye-forming coupler, and a hydrazone reducing agent capable in oxidized form of reacting with the dye-forming coupler, improvements are provided by the combination of (a) a hydrazone reducing agent that is an aminosulfonylhydrazone that is capable of developing an image in the photothermographic material and that is capable, upon oxidation, of releasing an aminosulfinic acid, which, in turn, thermally releases ammonia or an amine and (b) an ammonia or amine responsive imaging material. Such a sulfonylhydrazone is, for example, represented by the formula:

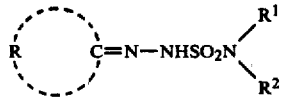

(I)

wherein

R is the atoms necessary to complete a nitrogen containing 5 or 6 member heterocyclic ring or a benzo substituted nitrogen containing 5 or 6 member heterocyclic ring;

$R^1$ and $R^2$ are individually hydrogen or alkyl containing 1 to 5 carbon atoms, such as methyl, ethyl, propyl, butyl and pentyl, or together are the atoms selected from the group consisting of carbon, hydrogen, oxygen, and nitrogen atoms necessary to complete a 5 or 6 member heterocyclic ring. The sulfonylhydrazone is capable upon being heated and upon oxidative coupling of imagewise release of a thermally decomposable aminosulfinic acid. The aminosulfinic acid is, in turn, capable of thermally decomposing to form ammonia or an amine.

The ammonia or amine responsive imaging material in the photothermographic material comprises, for example, an aromatic 1,2-dialdehyde capable of reacting with ammonia or an amine and/or a reducible cobalt (III) complex, such as one containing releasable amine ligands.

A silver image and an image from the ammonia or amine responsive imaging material are produced in the photothermographic material, after imagewise exposure by merely heating the photothermographic material to moderately elevated temperatures. Such heating enables silver halide development and, upon oxidation of the sulfonylhydrazone, imagewise release of a thermally decomposable aminosulfinic acid from the sulfonylhydrazone. The decomposable aminosulfinic acid thermally decomposes to produce ammonia or an amine. The ammonia or amine reacts with the ammonia or amine responsive imaging material. The process preferably produces a dye in the ammonia or amine responsive imaging material, preferably a dye that enhances a silver image produced from the photographic silver halide.

DETAILED DESCRIPTION OF THE INVENTION

A dye image, preferably a dye image that enhances a silver image, is produced according to the invention by means of a photothermographic material comprising the sulfonylhydrazone that is capable upon oxidative coupling of releasing a thermally decomposable aminosulfinic acid that is, in turn capable of thermally releasing ammonia or an amine. The dye image absorbs radiation in the ultraviolet or visible regions of the electromagnetic spectrum. The dye-forming coupler in the photothermographic material according to the invention aides image formation by oxidatively coupling at processing temperature with the oxidized form of the sulfonylhydrazone. This oxidative coupling reaction can form an image dye that is visible in the visible region of the electromagnetic spectrum. Optionally, the oxidative coupling reaction can form a dye that absorbs in the ultraviolet region or infrared region of the electromagnetic spectrum. The oxidative coupling reaction must not adversely affect the release of the thermally decomposable aminosulfinic acid from the sulfonylhydrazone. The dye formed by the oxidative coupling reaction can enhance or complement the silver image formed in the photothermographic material and/or the dye image formed in the ammonia or amine responsive imaging-forming material.

A photothermographic material according to the invention comprises at least one image-forming material that generates an image dye at processing temperature in response to the presence of ammonia or amine from the aminosulfinic acid decomposition. For example, the photothermographic material optionally comprises an aromatic 1,2-dialdehyde, such as ortho-phthalaldehyde, capable of reacting with ammonia or an amine generated from the thermal decomposition of aminosulfinic acid. An advantage of such photothermographic materials comprising photographic silver halide and an image-forming material that generates an image in response to the presence of ammonia or an amine is that the photographic silver halide is useful for its high degree of photosensitivity and the image-forming material that generates an image in response to the presence of ammonia or an amine, such as a reducible cobalt (III) complex, provides desired image discrimination and image density enhancement.

Many sulfonylhydrazone compounds within structure (I) are useful in a photothermographic material and process according to the invention. Combinations of such sulfonylhydrazone compounds are also useful. Examples of useful sulfonylhydrazones include the following:

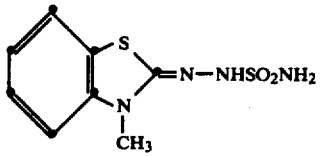

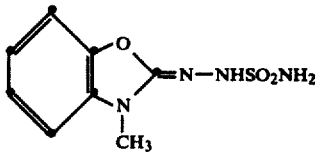

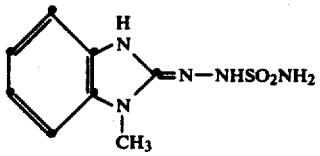

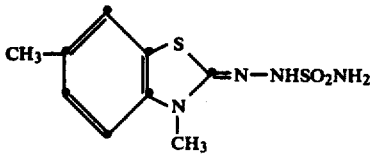

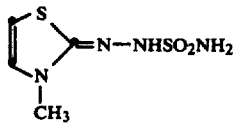

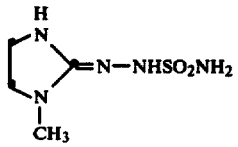

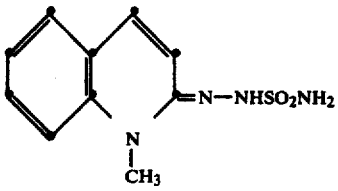

-continued

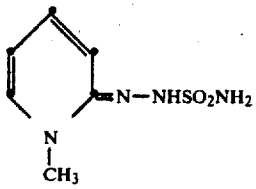

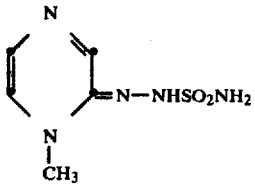

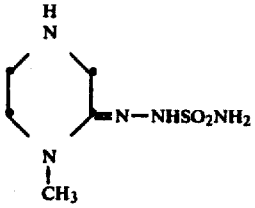

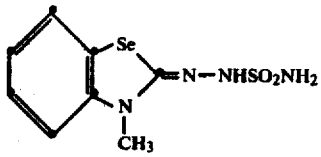

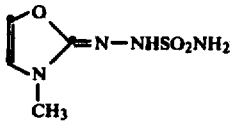

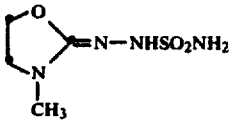

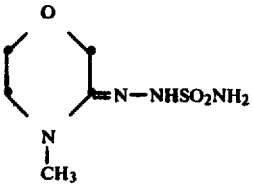

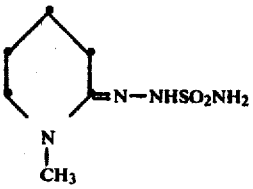

-continued

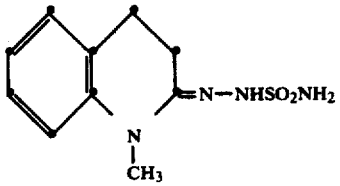

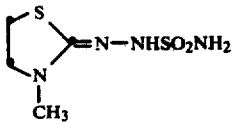

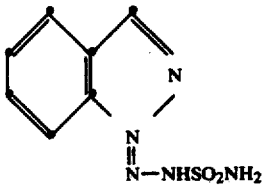

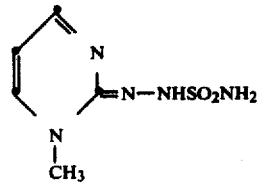

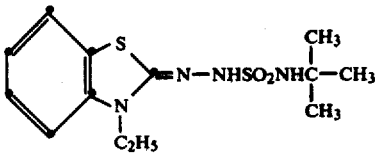

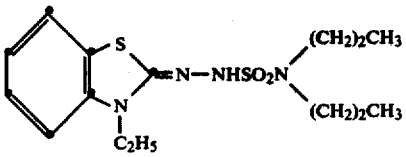

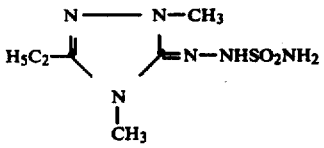

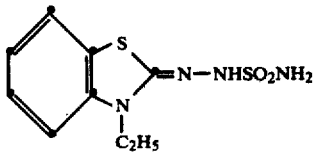

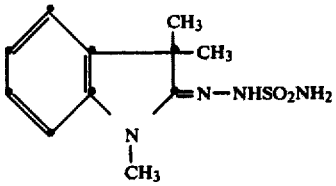

-continued

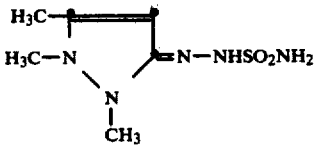

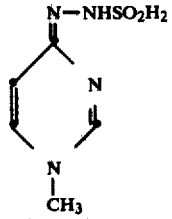

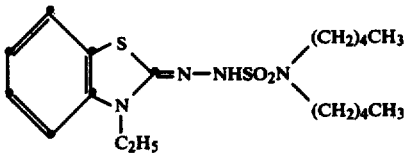

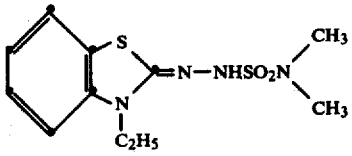

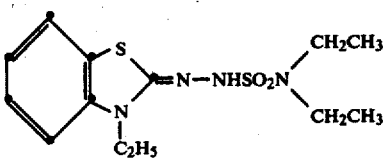

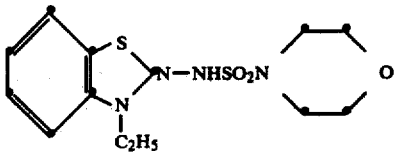

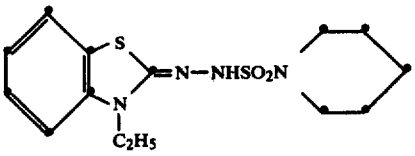

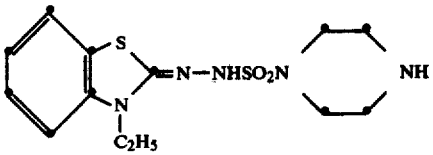

The sulfonylamine group of the sulfonylhydrazone within structure (I) must be capable of being released upon oxidation of the sulfonylhydrazone to provide an aminosulfinic acid fragment that is capable of thermally releasing ammonia or amine. The groups on the sulfonylhydrazone nucleus should not adversely affect the capability of the sulfonylamine group from being released upon oxidation of the sulfonylhydrazone.

Preferred sulfonylhydrazone compounds within structure (I) are represented by the formula:

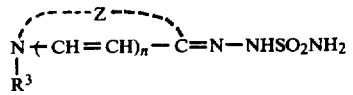

wherein $R^3$ is alkyl containing 1 to 5 carbon atoms or hydrogen;

Z is the atoms, preferably atoms selected from the group consisting of carbon, hydrogen, oxygen, sulfur, and selenium atoms, necessary to complete a 5 or 6 member heterocyclic ring or a benzo substituted 5 or 6 member heterocyclic ring, such as a benzothiazole, benzoxazole, benzimidazole, thiazole, selenazole, or oxazole ring; and n is 0 or 1.

The term "alkyl" herein includes unsubstituted alkyl, such as unsubstituted methyl, ethyl, propyl, butyl or pentyl. The term also includes alkyl that is substituted by a group which does not adversely affect the desired properties of the photographic material, the sulfonylhydrazone or the aminosulfinic acid fragment released upon oxidation. Examples of useful substituted alkyl groups include alkyl substituted by alkoxy, carboxamido, methoxy or methylsulfonamido.

The optimum sulfonylhydrazone according to the invention will depend upon such factors as the desired image, particular photothermographic material, processing steps and conditions, particular photographic silver halide in the photographic material, other components in the photographic material and ammonia or amine responsive material with which the sulfonylhydrazone is useful.

The sulfonylhydrazone compounds according to the invention are prepared by a series of steps known in the organic synthesis art. An illustrative process of preparing such a sulfonylhydrazone is the preparation of 3-N-ethyl-2-benzothiazolinone aminosulfonylhydrazone. This process comprises, for example, the steps: 3.6 Grams of 3-N-ethyl-2-benzothiazolinone hydrazone are dissolved in 35 ml of dry pyridine and the solution cooled to 5°-10° C. 3.5 Grams of t-butylsulfamyl chloride are added followed by five hours of stirring at room temperature (about 20° C.). After standing for four days at room temperature (about 20° C.), the pyridine is evaporated under vacuum and the residue triturated with a composition consisting of equal parts by volume of water and ethyl acetate. The resulting solids are filtered and dried to yield the corresponding t-butylaminosulfonyl hydrazone (M.P. 157°-158° C.). 4 Grams of this hydrazone are added, in portions, to 35 ml of trifluoroacetic acid and the resulting solution is stirred for about 15 hours at room temperature (about 20° C.). Following evaporation to dryness, the residue is triturated with cold aqueous sodium bicarbonate in ethyl acetate. The resulting solids are filtered, washed with water and dried to provide the desired crude product. The crude product is purified, such as by refluxing in 100 ml of ethyl acetate and 50 ml of acetone, evaporating to one half volume, and filtering. The filtrate is further concentrated, chilled and triturated with n-pentane to yield the desired pure product (M.P. 140°-141° C.). This method of preparation is adaptable to preparation of other sulfonylhydrazones that are capable of developing an image in a photothermographic material according to the invention. For example, when the trifluoroacetic acid hydrolysis step is deleted, then compounds, such as

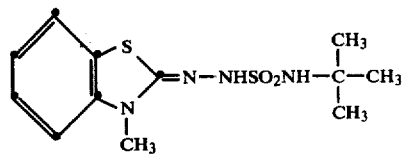

can be prepared by the described procedure.

Generally, the sulfonylhydrazone is colorless in a photothermographic material prior to processing. Some of the sulfonylhydrazones have a slight color in a photothermographic material. This slight color is not considered unacceptable.

The term "colorless" herein means that the sulfonylhydrazone according to the invention does not absorb radiation to an undesired degree in the visible region of the electromagnetic spectrum. In some photographic materials, the sulfonylhydrazones absorb radiation in certain areas of the electromagnetic spectrum which does not adversely affect the desired properties of the photographic material or the desired image formed upon processing.

The hue of the image produced in a photothermographic material comprising a sulfonylhydrazone according to the invention varies depending upon such factors as the particular amine responsive imaging material, processing conditions, particular coupler and other components in the photothermographic material.

The photothermographic materials according to the invention comprise photographic silver halide. It is essential that the photographic silver halide not adversely affect the desired imaging process, such as the ammonia release reaction that occurs in the photographic material upon processing. Examples of useful photographic silver halides are silver chloride, silver bromide, silver bromoiodide, silver chlorobromoiodide, silver iodide and mixtures thereof. The photographic silver halide is generally present in the photographic material in the form of an emulsion which is a dispersion of the photographic silver halide in a binder. The photographic silver halide is present in a range of grain sizes from fine grain to coarse grain. The composition containing the photographic silver halide as prepared by any of the well known procedures in the photographic art, especially the photothermographic art, such as described in *Research Disclosure,* December 1978, Item No. 17643 and *Research Disclosure,* June 1978, Item No. 17029. The photographic silver halide material contains addenda commonly present in photographic silver halide materials, especially photothermographic silver halide materials, such as chemical sensitizers, antifoggants, emulsion stabilizers, brighteners, light absorbing or scattering materials, hardeners, coating aids, plasticizers, lubricants and antistatic materials, matting agents, development modifiers and other addenda described in the above *Research Disclosure* publications. The photographic silver halide can comprise, for example, internal image photographic silver halide and internally sensitized covered grain silver halide to produce positive images.

The photographic silver halide in the photothermographic material is optionally prepared in situ. The photothermographic composition, for example, can contain photographic silver halide that is prepared in or on one or more of the other components of the photothermographic material rather than prepared separate from the described components and then admixed with them. Such a method of preparing silver halide in situ is described in, for example, U.S. Pat. No. 3,457,075, the description of which is incorporated herein by reference.

The photographic silver halide is generally spectrally sensitized by means of spectral sensitizing dyes, such as described in *Research Disclosure,* December 1978, Item No. 17643, and *Research Disclosure,* June 1978, Item No. 17029. Spectral sensitizing dyes which are useful in the photothermographic materials include polymethine sensitizing dyes which include the cyanines, merocyanines, complex cyanines and merocyanines (including tri-, tetra- and polynuclear cyanines and merocyanines), as well as oxonols, hemioxonols, styryls, merostyryls and streptocyanines. Combinations of spectral sensitizing dyes are useful.

The photothermographic material contains a range of concentrations of photographic silver halide. An optimum concentration of photographic silver halide will depend upon such factors as the desired image, processing conditions, particular sulfonylhydrazone according to the invention, other components in the photothermographic material and the ammonia or amine responsive image-forming material with which the sulfonylhydrazone is useful. A preferred concentration of photographic silver halide in the photothermographic material is within the range of about 0.1 mg to about 10 mg of silver per square decimeter of support. The coverage of the photographic silver halide is generally less than otherwise might be useful due to the enhancing properties of the image produced in the ammonia or amine responsive material upon processing.

The sulfonylhydrazone is in any suitable location in the photothermographic material which produces the desired image and the desired sulfonylamine fragment upon processing. The sulfonylhydrazone is in a location with respect to the photographic silver halide that produces a silver image and releases a thermally decomposable aminosulfinic acid upon appropriate processing. If desired a portion of the sulfonylhydrazone is in a layer contiguous to the layer of the photographic element comprising photographic silver halide. The term "in reactive association" herein means that the photographic silver halide and the sulfonylhydrazone are in a location with respect to each other which enables the photothermographic material upon processing to produce a desired image and release ammonia or an amine by means of the released aminosulfinic acid.

Many developing agents are useful in combination with the sulfonylhydrazone reducing agents for developing an image in a photothermographic material. Silver halide developing agents with which the sulfonylhydrazones are useful are described in, for example, the above *Research Disclosure* publications. Examples of useful silver halide developing agents include those described in Paragraph IV, System B of *Research Disclosure,* June 1978, Item No. 17029. Examples of such developing agents include, for example, 3-pyrazolidones, such as 1-phenyl-3-pyrazolidone and 4-hydroxymethyl-4-methyl-1-phenyl-3-pyrazolidone, and sulfonamidophenols, such as 2,6-dichloro-4-benzenesulfonamidophenol and 2,6-dibromo-4-benzenesulfonamidophenol.

The silver halide developing agent or silver halide developing agent combination is useful in a range of concentrations in the photothermographic material. A preferred concentration of developing agent or developing agent combination is within the range of about 0.1 to about 10.0 moles of developing agent or developing agent combination per mole of photographic silver halide in the photothermographic material.

The term "developing agent" herein includes compounds which are developing agents and developing agent precursors. That is those compounds are included which are not developing agents in the photothermographic material until a condition occurs, such as heating or contact with a suitable activator for the photothermographic material.

The tone of the image, such as the silver image and the image produced in the ammonia or amine responsive material, varies depending upon such factors as the silver morphology of the developed silver image, covering power of the silver materials, the particular sulfonylhydrazone, processing conditions, concentration of components and other materials present during imaging. In photothermographic materials that provide a brown silver image, an image in the ammonia or amine responsive imaging material that is especially useful is one that is complimentary in hue to the silver image.

The photothermographic materials preferably comprise a binder. Binders are useful alone or in combination in the photothermographic materials. Useful binders include both naturally occurring substances such as proteins, for example, gelatin, gelatin derivatives, cellulose derivatives, polysaccarides such as dextran, gum arabic and the like, and synthetic polymeric materials which are compatible with the sulfonylhydrazone and other components in the photothermographic material. Hydrophobic binders are useful in the photothermographic materials. Such binders include polymers of alkylacrylates and methacrylates, acrylic acid, sulfoalkyl acrylates or methacrylates and those which have crosslinking sites that facilitate hardening or curing. Other useful hydrophobic binders include high molecular weight materials and resins such as poly(vinylbutyral), cellulose acetate butyrate, poly(methylmethacrylate), poly(styrene), poly(vinylchloride), chlorinated rubber, poly(isobutylene), butadiene-styrene copolymers, vinylchloride-vinylacetate copolymers, copolymers of vinylacetate, vinylchloride and maleic anhydride and the like. It is important that the binder, especially the hydrophobic binder, not adversely affect the sensitometric properties and other desired properties of the photothermographic material especially the properties of ammonia or amine transfer to the ammonia or amine responsive imaging material. Poly(vinylbutyral) is especially useful as a binder in the photothermographic silver halide material. This is available under the trademark "Butvar" from the Monsanto Company, U.S.A.

The photothermographic elements optionally contain an overcoat layer and/or interlayer and/or subbing layer to provide desired properties. The overcoat layer, for example, increases resistance to abrasion and other markings on the element. The overcoat layer, interlayer or subbing layer contain, alone or in combination, vehicles and binders that are useful in the layer of the element containing the photographic silver halide.

The photothermographic element comprises a variety of supports. Useful supports include those which are resistant to adverse changes in structure due to processing conditions and which do not adversely affect the desired sensitometric properties of the photothermographic materials. Useful supports include, for example, poly(vinylacetal), poly(ethylene terephthalate) and polycarbonate films, as well as related films and resinous materials. Glass, paper, metal and the like supports are also useful. A flexible support is generally most useful.

The photothermographic materials are coated on a support by procedures known in the photographic art. Such procedures include, for example, immersion or dip coating, roller coating, reverse roll coating, air knife coating, doctor blade coating, spray coating, extrusion coating, dip coating, stretch flow coating and curtain coating.

The photothermographic materials are generally imagewise exposed by means of various forms of energy to produce a developable image. Such forms of energy include those to which the photographic silver halide in the photothermographic material is sensitive. These forms of energy encompass the ultraviolet, visible and infrared regions of the electromagnetic spectrum, as well as electron beam and beta radiation, gamma ray, x-ray, alpha particle, neutron radiation and other forms of radiant energy in either non-coherent (random phase) forms or coherent (in phase) forms as produced by lasers. Exposures are monochromatic, orthochromatic or panchromatic, depending upon the spectral sensitization of the photographic silver halide. Imagewise exposure is generally for time and intensity sufficient to produce a developable image in the photothermographic material.

The photothermographic materials are processed in a single step or multistep process to produce a silver image in the photothermographic layer comprising photographic silver halide and an image in the ammonia or amine responsive imaging material. In a single step process the photothermographic element after exposure is heated to processing temperature to produce a silver image in the photothermographic layer and imagewise release ammonia or an amine from the sulfonylhydrazone reducing agent. The ammonia or amine from the thermally decomposable aminosulfinic acid from the sulfonylhydrazone activates image formation in the ammonia or amine responsive imaging material to enable formation of both an image in silver and an image from the ammonia or amine responsive imaging material. The heating step in a single step process is sufficient to enable development of silver halide and release ammonia or amine from the thermally decomposable aminosulfinic acid from the sulfonylhydrazone to activate the imaging material that is responsive to ammonia or amine. In a multistep process the initial heating step is sufficient to enable development of the exposed photographic silver halide. Subsequent steps are then at optionally higher temperatures to enable ammonia release to activate the ammonia or amine responsive imaging material. Processing temperatures in the single step process are within the range of about 100° C. to about 200° C. Preferably the single step process is carried out at a processing temperature which does not adversely affect the support of the photographic element, such as a temperature within the range of about 100° C. to about 150° C. The second and subsequent processing steps which release ammonia or amine from the thermally decomposable aminosulfinic acid from the sulfonylhydrazone in a multistep process are carried out at a temperature within the range of about 100° C. to about 200° C., generally within the range of about 130° C. to about 150° C.

Heating is carried out until a desired image is developed, generally within about 2 to about 90 seconds. Selection of an optimum processing time and temperature for each processing step will depend upon such factors as the desired image, particular components of the photothermographic element, the ammonia or amine responsive imaging material and the particular sulfonylhydrazone.

A variety of means are useful to heat the photothermographic material to develop the desired image. The heating means is, for example, a single hot plate, iron, roller, heated drum, infrared heating means, hot air heating means and the like.

Processing is preferably carried out under ambient conditions of pressure and humidity. Pressures and humidity outside normal atmospheric conditions are also useful.

The photothermographic material comprises an ammonia or amine responsive imaging material. A preferred example of such an ammonia or amine responsive material is one that comprises an aromatic 1,2-dialdehyde capable of reacting with ammonia or amine. Such an aromatic 1,2-dialdehyde is, for example, orthophthalaldehyde capable of reacting with ammonia or amine generated from the thermally decomposable aminosulfinic acid from the sulfonylhydrazone. The photothermographic material also preferably comprises a reducible cobalt (III) complex containing releasable ammonia or amine ligands.

A preferred photothermographic element comprises a support bearing, in reactive association, a photothermographic layer comprising photographic silver halide and a sulfonylhydrazone that is capable of developing an image in the photothermographic layer and that is capable upon oxidative coupling of releasing an aminosulfinic acid which, in turn is capable of thermally releasing ammonia or an amine; and, also comprising, in at least one operatively associated layer, an ammonia or amine activatable image precursor composition comprising at least one cobalt (III) complex having releasable ligands and an image-forming material which generates an image in response to the release of the ligands. A preferred cobalt (III) complex image precursor composition comprises a cobalt (III) hexammine complex and ortho-phthalaldehyde. Such cobalt (III) complex image-forming materials are known in the imaging art and are described in, for example, *Research Disclosure* Item No. 16845; *Research Disclosure* Item No. 12617; *Research Disclosure* Item No. 18535; *Research Disclosure* Item No. 15874; *Research Disclosure* Item No. 18436; U.S. Pat. No. 4,273,860; U.K. Published Application No. 2,012,445A; European Pat. No. 12,855 and Published Application WO 80/01322, the disclosures of which are incorporated herein by reference. Orthophthalaldehyde is a preferred aromatic 1,2-dialdehyde. Other examples of aromatic dialdehydes capable of forming a dye according to the invention include 4-hydroxy-, 4-benzolyoxy-, 4-methacryloyloxy, 4-t-butyl- and 4-bromo-1,2-dicarboxaldehyde; 5,6,7,8-tetrahydro-5,5,8,8-tetramethylnaphthylene-2,3-dicarboxyaldehyde and 2,3-naphthalenedicarboxaldehyde.

Preferred cobalt (III) complexes useful in imaging according to the invention feature a molecule having a cobalt atom or ion surrounded by a group of atoms, ions or other molecules which are generically referred to as ligands. The cobalt atom or ion in the center of these complexes is a Lewis acid while the ligands are Lewis bases. Trivalent cobalt complexes, that is cobalt (III) complexes, are generally most useful because the ligands are relatively tenaciously held in these complexes and released when the cobalt is reduced to the (II) state.

Preferred cobalt (III) complexes are those having a coordination number of 6. A wide variety of ligands are useful to form a cobalt (III) complex. The preferred cobalt (III) complex is one which aids in generating ammonia or amine. Cobalt (III) complexes which rely upon chelation of cobalt (II) to form dye are also useful. Useful amine ligands in cobalt (III) complexes include, for example, methylamine, ethylamine, ammines, and aminoacids such as glycinato. The term "ammine" refers to ammonia, when functioning as a ligand, whereas "amine" indicates the broader class noted above. The ammine complexes are highly useful in producing images.

Useful cobalt (III) complexes include neutral compounds which are entirely free of either anions or cations. Useful cobalt (III) complexes also include one or more cations and anions as determined by the charged neutralization rule. Herein the terms "anion" and "cation" refer to non-ligand anions and non-ligand cations unless otherwise indicated. Useful cations are those which produce readily soluble cobalt (III) complexes such as alkali metal and quaternary ammonium cations.

A wide variety of anions are useful, such as those listed in *Research Disclosure* Item No. 18436. The choice of an optimum anion depends in part on whether or not added compounds are present that are sensitive to, or reactive with, the anion.

The image-forming material containing a cobalt (III) complex optionally comprises compounds or compositions in addition to the cobalt (III) complex. Such materials are, for example, dye forming materials or dyes which are bleachable in response to ammonia or amines. Examples of dye forming materials which also comprise destabilizer materials to interact with the cobalt (III) complex are known in the photographic art such as described in U.S. Pat. No. 4,273,860, the description of which is incorporated herein by reference. Such dye forming materials include, for example, 4-methoxynapthol which forms a blue dye when oxidized and protonated diamine destabilizer material which when associated with a conventional color coupler will form a dye when it is oxidized by the reduction of the cobalt (III) complex. Examples of image-forming materials useful in addition to a destabilizer material include phthalaldehyde, also present as an amplifier; and ammonia-bleachable or color alterable dye such as a cyanine dye, styryl dye, rhodamine dye, azo dye or pyrylium dye; a dye precursor such as an ninhydrin or a blocked leuco dye; or a diazo-coupler material which is capable of forming an azo dye. Details of these examples are described in, for example, *Research Disclosure,* October 1974, Item No. 12614; *Research Disclosure,* December 1976, Item No. 15246; *Research Disclosure,* June 1977, Item No. 15874; and *Research Disclosure,* August 1979, Item No. 18183; the disclosures of which are incorporated herein by reference. Other optional addenda are compounds which will chelate with the cobalt (II) to form a dye.

When ammonia- or amine-bleachable image-forming materials are present in the photothermographic element the ammonia- or amine-bleachable materials are preferably in a layer separate from the ammonia or amine producing components of the material.

The layer comprising cobalt (III) complexes preferably comprises a binder. Useful binders are described in, for example, *Research Disclosure,* October 1974, Item No. 12617, the description of which is incorporated herein by reference. Generally useful binders are acetates, cellulose compounds, vinyl polymers, polyacrylates and polyesters. In addition, it is preferred that the binder be selected which will maximize the preferred hue and density of the image produced upon exposure and development. Preferred examples of such binders include polysulfonamides, for example, poly(ethylene-co-1,4-cyclohexylene-dimethylene-1-methyl-2,4-benzenedisulfonamide), poly(ethylene-co-hexamethylene-1-methyl-2,4-benzenedisulfonamide) and poly(methacrylonitrile).

A preferred ammonia or amine responsive element comprises a support having thereon a layer comprising, in a sulfonamide binder, phthalaldehyde and a hexammine cobalt (III) trifluoroacetate which is overcoated with a suitable polymeric overcoat such as a poly(acrylamide-co-N-vinyl-2-pyrrolidone-co-2-acetoacetoxyethylmethacrylate). Such an imaging element when placed contiguous to or laminated to a photothermographic element containing photographic silver halide and a sulfonylhydrazone according to the invention produces a dye image upon heating the laminate or combined layers during processing.

Another form of photothermographic material comprises, in binder, in reactive association, (a) photographic silver halide which is formed in situ or ex situ,
(b) an oxidation-reduction image-forming combination comprising:
  (i) an organic metal salt oxidizing agent, such as an organic silver salt oxidizing agent, with
  (ii) a hydrazone reducing agent for the organic silver salt oxidizing agent which is a sulfonylhydrazone according to the invention; and
(c) an ammonia or amine responsive imaging material, This photothermographic material is also imagewise exposed to light to produce a developable image in the photographic silver halide material.

A variety of organic silver salt oxidizing agents are useful in the photothermographic material. Examples of useful organic silver salt oxidizing agents are described in, for example, *Research Disclosure,* June 1978, Item No. 17029, the description of which is incorporated herein by reference. Examples of useful organic silver salt oxidizing agents include silver behenate, silver stearate, silver palmitate and silver salts of other compounds such as silver salts of 1,2,4-mercapotriazole derivatives such as described in *Research Disclosure,* June 1977, Item No. 15869. Another useful class of organic silver salt oxidizing agent is represented by complexes or salts of silver with a nitrogen acid, such as a nitrogen acid selected from the group consisting of imidazole, pyrazole, urazole, 1,2,4-triazole and 1H-tetrazole nitrogen acids or combinations of these acids. The silver salts or complexes of nitrogen acids are described in, for example, *Research Disclosure,* October 1976, Item No. 15026, the disclosure of which is incorporated herein by reference. Examples of useful silver salts or complexes of nitrogen acids include silver salts or complexes of 1H-tetrazole; dodecyl tetrazole; 5-n-butyl-1H-tetrazole; 1,2,4-triazole; urazole; pyrazole; imidaziole; and benzimidazole. A further class of useful organic silver salt oxidizing agents include silver salts of certain heterocyclic ion compounds such as described in U.S. Pat. No. 3,893,860, the description of which is incorporated herein by reference. Selection of an optimum organic silver salt or complex oxidizing agent, or combination of such oxidizing agents, will depend upon such factors as the desired image, particular silver halide, processing temperature and other conditions, particular sulfonylhydrazone reducing agent and other addenda in the photothermographic material.

The terms "salt" and "complex" herein include any type of bonding or complexing mechanism which enables the resulting material to provide desired imaging properties in the photothermographic materials according to the invention. In some instances, the exact bonding of the described organic silver salt or complex is not fully understood. The terms "salt" and "complex" are intended to include neutral complexes and non-neutral complexes.

A preferred photothermographic element comprises on a support, in a poly(vinylbutyral) binder, in reactive association, a photothermographic layer comprising photographic silver halide and an oxidation-reduction image-forming combination comprising:

(i) an organic silver salt oxidizing agent consisting essentially of silver behenate, and (ii) a hydrazone reducing agent consisting essentially of 3-methyl-2-benzothiazolinone aminosulfonylhydrazone, and contiguous to the photothermographic layer, an ammonia responsive cobalt (III) complex imaging layer comprising, in a polysulfonamide binder, a cobalt (III) hexammine complex and ortho-phthalaldehyde.

A stabilizer or stabilizer precursor is optionally present in the photothermographic material to provide improved post-processing image stability. It is desirable in most instances to stabilize the silver halide after processing in order to avoid post-processing print-up. A variety of stabilizers and stabilizer precursors are useful in the photothermographic materials. The stabilizers and stabilizer precursors are useful alone or in combination. Generally useful stabilizers and stabilizer precursors are sulfur compounds that form a stable silver mercaptide after image development with the photosensitive silver material at processing temperatures. Photolytically active halogenated organic compounds are also useful in such photothermographic materials. Such stabilizers and stabilizer precursors are described in, for example, *Research Disclosure,* June 1978, Item No. 17029, the description of which is incorporated herein by reference. Selection of an optimum stabilizer or stabilizer precursor or combination thereof will depend upon such factors as the particular photosensitive silver halide, processing conditions, desired image, particular sulfonylhydrazone reducing agent, and other components in the photothermographic material.

The photothermographic material generally comprises an image toner, also designated as a toning agent, to produce a more neutral appearing or black tone image upon processing. Combinations of image toners are also useful. The optimum toning agent or toning agent combination will depend upon such factors as the particular silver halide, the desired image, particular processing conditions, particular sulfonylhydrazone and other components in the photothermographic material. Useful toning agents can be selected from those described in, for example, *Research Disclosure,* June 1978, Item No. 17029, the description of which is incorporated herein by reference.

The toning agent or combination of toning agents are useful in a range of concentrations in a photothermographic material. The optimum concentration of toning agent or toning agent combination will depend upon the described factors such as the particular photosensitive silver halide, particular processing conditions, desired image, particular sulfonylhydrazone and other components in the photothermographic material. A preferred concentration of toning agent or toning agent combination is within the range of about 0.01 to about 0.1 mole of toning agent per mole of organic silver salt oxidizing agent in the photothermographic material.

The photothermographic material generally comprises a melt-forming compound or combination of melt-forming compounds to aid in processing. The melt-forming compound or combination of melt-forming compounds generally provides an improved developed image. The term "melt-forming compound" herein means a compound which upon heating to the described processing temperature produces an improved reaction medium, generally a melt medium, within which the image-forming combination and photosensitive component produce better image development. The exact nature of the reaction medium in the photothermographic material at processing temperatures is not fully understood. It is believed at the reaction temperatures a melt occurs which permits the reaction components to better interact and to fuse into contiguous layers of the photothermographic element. Useful melt-forming compounds are generally components separate from the image-forming combination, although the image-forming combination and other addenda in the photothermographic material generally enter into the melt formation. Examples of useful melt-forming compounds are amides, imides, cylic ureas and triazoles which are compatible with other components of the photothermographic materials. Useful melt-forming compounds can be selected from those described in, for example, U.S. Pat. No. 3,438,776. Illustrative melt-forming compounds include acetamide, 1,3-dimethylurea, N-propylurea, 2-pyrrolidone and formamide.

The melt-forming compound or combination of melt-forming compounds are useful in a range of concentrations in the photothermographic materials. The preferred concentration of melt-forming compound or combinations of melt-forming compounds are within the range of about 0.5 to about 2 parts by weight of melt-forming compound per gram of organic silver salt oxidizing agent in the photothermographic material. The optimum concentration of melt-forming compound or combination of melt-forming compounds will depend upon the described factors.

A photothermographic material according to the invention comprises a dye-forming coupler. Useful dye-forming couplers form dyes that absorb in the visible region of the electromagnetic spectrum and/or form dyes that are visible in the ultraviolet or infrared regions of the electromagnetic spectrum. Such dye-forming couplers are described in, for example, *Research Disclosure,* December 1978, Item No. 17643. Preferred dye-forming 4-equivalent couplers include resorcinol couplers as described in U.S. Pat. No. 4,126,461; diacylaminophenol couplers described in U.S. Pat. No. 2,772,162; couplers containing fluoroalkylcarbonamido groups described in U.S. Pat. No. 2,895,826; 1-naphthol-2-carboxylic acid amide couplers described in U.S. Pat. No. 2,474,293; 1-hydroxynaphthamide couplers described in U.S. Pat. No. 3,002,836; acylated amino pyrazolone couplers described in U.S. Pat. No. 2,369,489; halogen substituted 1-phenyl-3-acylamino-5-pyrazolone couplers described in U.S. Pat. No. 2,600,788; couplers containing a phenoxy acylamino group as described in U.S. Pat. No. 2,908,573; substituted 1-phenyl-3-amido-5-pyrazolone couplers as described in U.S. Pat. No. 3,062,653; 5-pyrazolone couplers containing stabilizer radicals as described in U.S. Pat. No. 3,519,429; aceto-acetanilide couplers as described in U.S. Pat. No. 3,265,506; benzoylacetanilide couplers as described in U.S. Pat. No. 2,875,057; and, phenolic dye-forming couplers containing a ureido group as described in European Pat. No. 0028099, the disclosures of which are incorporated herein by reference. The term "4-equivalent coupler" herein means a dye-forming coupler that requires four moles of silver for each mole of dye formed in the photothermographic material according to the invention. Other examples of 4-equivalent couplers include:

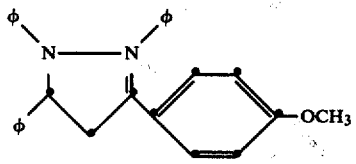

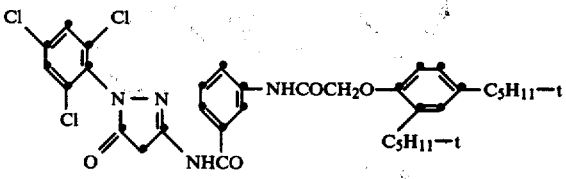

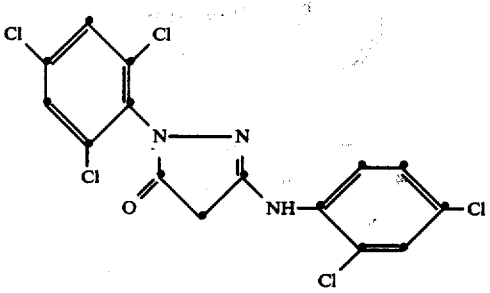

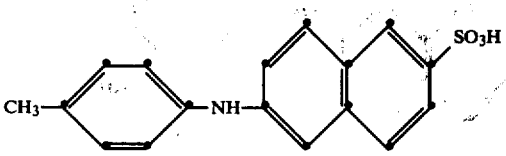

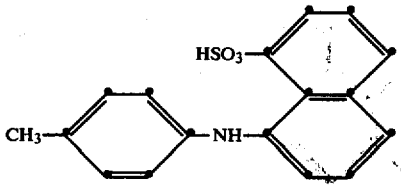

-continued

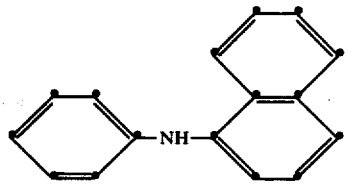

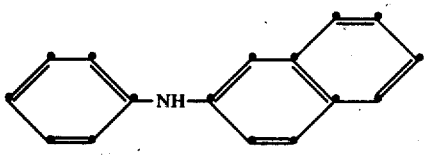

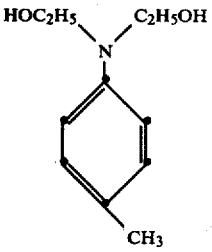

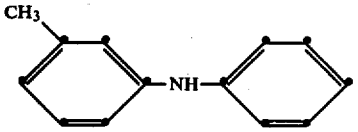

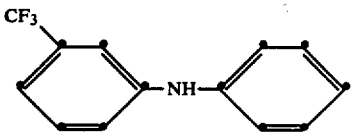

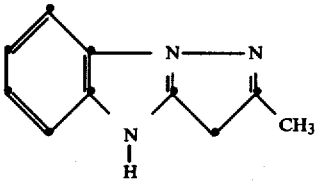

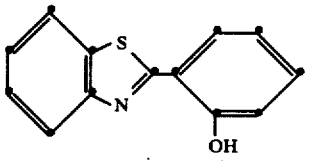

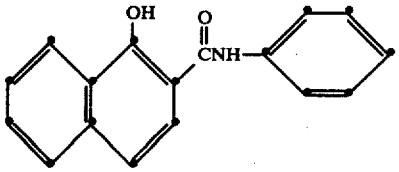

-continued
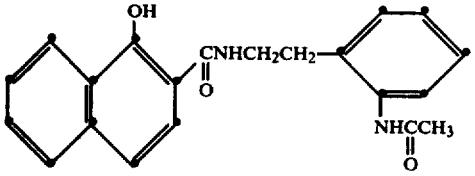
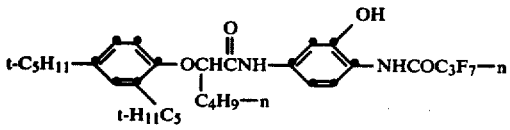
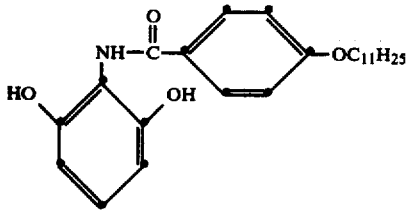
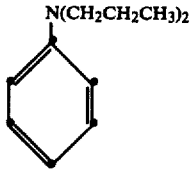
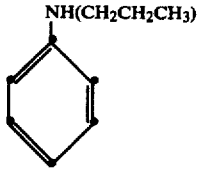
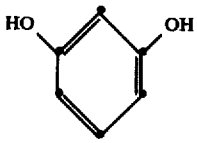
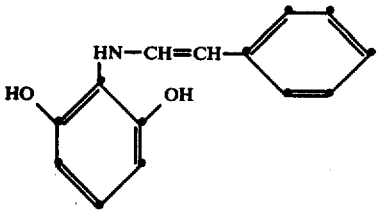
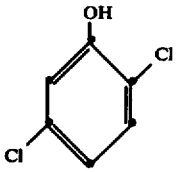
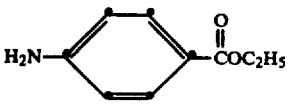
-continued
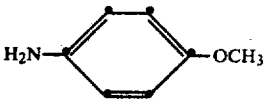
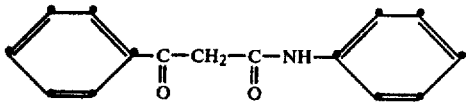
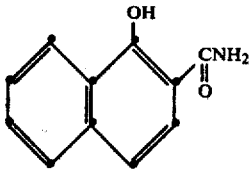
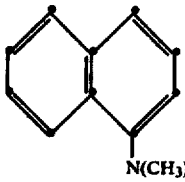
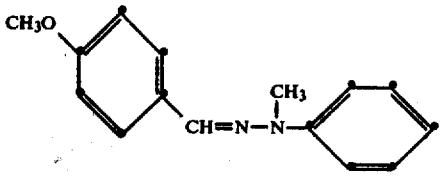
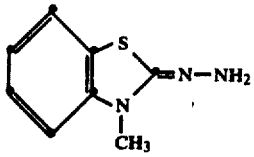
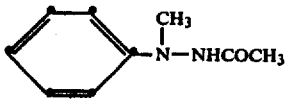
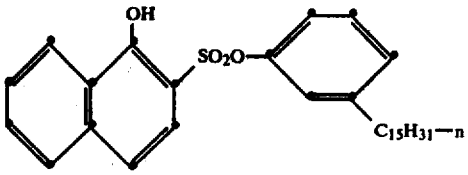
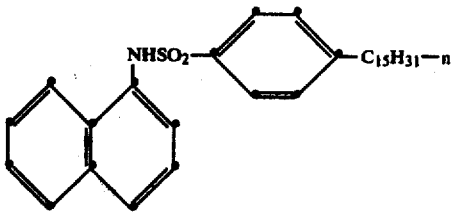

-continued

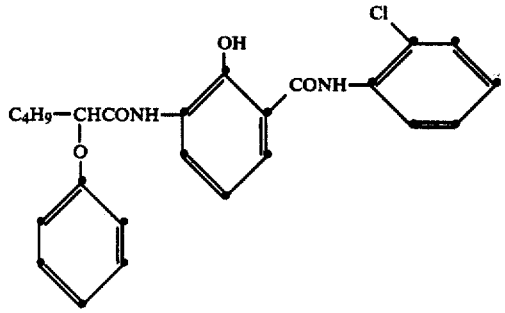

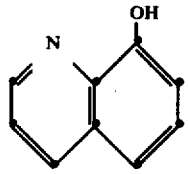

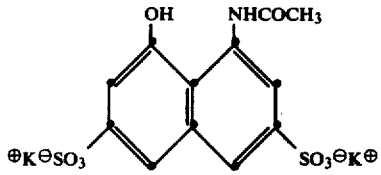

ϕ herein means a phenyl group.

The following examples are included for a further understanding of the invention.

EXAMPLE 1

Use of 3-methyl-2-benzothiazolinone N,N-dimethylaminosulfonylhydrazone

A heat-developable photographic element was prepared by mixing the following components, coating the resulting composition on a subbed poly(ethylene terephthalate) film support at a wet coating thickness of 102 microns (4 mil) and allowing the coating to dry:

| Component | Amount |
|---|---|
| acetone (solvent) | 1.0 g |
| poly(vinylbutyral) (binder) ((BUTVAR B-76, a a trademark of and available from Monsanto Co., U.S.A.)) (10% by weight in acetone) | 1.0 g |
| 3-methyl-2-benzothiazolium N,N—dimethylaminosulfonyl hydrazone: | 0.020 g |

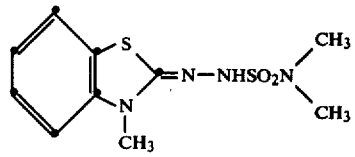

| | |
|---|---|
| 3-methyl-1-phenyl-2-pyrazolin-5-one (dye-forming coupler) | 0.014 g |
| silver behenate dispersion comprising: | 1.0 g |
| acetone | 406.9 g |
| toluene | 438.3 g |
| poly(vinylbutyral) (BUTVAR B-76) | 55.0 g |
| alumina | 8.8 g |

-continued

| Component | Amount |
|---|---|
| behenic acid | 31.2 g |
| lithium stearate | 5.9 g |
| silver behenate | 50.0 g |
| photographic AgBrI emulsion comprising: | 0.4 g |
| acetone | |
| poly(vinylbutyral) (BUTVAR B-76) | |
| lithium iodide, anhydrous | |
| lithium bromide, anhydrous | |
| silver trifluoroacetate | |
| 15.7% solids | |
| 40 g Ag/l solution | |
| $HgCl_2$ (antifoggant) (in one drop of dimethylformamide) | 0.001 g |
| 5-nitrobenzimidazole (antifoggant) | 0.003 g |

The resultant coating was overcoated with a 50.8 micron (2 mil) wet coating thickness of cellulose acetate (3 weight percent in water). The 3-methyl-1-phenyl-2-pyrazolin-5-one was selected for its good discriminate dye yield. The resulting photothermographic film contained 0.3 g/m$^2$ of silver as AgBrI and 0.35 g/m$^2$ of silver as silver behenate.

The photothermographic film was imagewise exposed to light through a step tablet for $10^{-3}$ seconds in a commercial sensitometer to provide a developable latent image in the film. Portions of the exposed film were processed by means of a phthalaldehyde-cobalt (III) complex image receiving element. The phthalaldehyde-cobalt (III) complex (PAC) image receiving element was prepared by mixing the following components and coating the resulting composition on a poly(ethylene terephthalate) film support:

| | |
|---|---|
| poly(ethylene-co-1,4-cyclohexylene-dimethylene-1-methyl-2,4-benzene-disulfonamide) (binder) | 76.6 mg/dm$^2$ |
| phthalaldehyde | 25.1 mg/dm$^2$ |
| cobalt (III) hexammine trifluoroacetate | 12.5 mg/dm$^2$ |

The exposed photothermographic AgBrI film (silver donor) was placed in face-to-face contact with the unovercoated PAC image receiving element. The resulting composite laminate was passed six times through a set of rollers at 130° C. The composite laminate was then heated on a vapor heated drum for five seconds at 150° C. The heated roller treatment seemed to precondition the PAC image receiving element portion of the laminate because the PAC image receiving element would only fog imagewise during the 150° C. heating step. The silver image in the photothermographic AgBrI film portion of the laminate was developed during the 130° heating step and became completely fogged during the 150° C. heating step that was necessary to fog the PAC image receiving element. The image developed in the photothermographic AgBrI film had a maximum density of 2.4 (to blue light) and a minimum density of 2.0 after the 150° C. heating step. The neutral (black) image in the PAC image receiving element had a maximum density of 3.3 and a minimum density of 0.1.

To illustrate another method of processing, a separate portion of the exposed photothermographic AgBrI film was heated for five seconds at 130° C. to develop a silver image. The resulting developed film was then laminated to a portion of a PAC image receiving element. The resulting laminate was heated at 150° C. to form a black image in the PAC image receiving element.

EXAMPLE 2

Use of 3-ethyl-2-benzothiazolinone aminosulfonylhydrazone

The procedure described in Example 1 was repeated with the exceptions that (a) the photothermographic AgBrI film was overcoated with a poly(isobutylene) rubber (VISTANEX MM-L140, which is a trademark of and available from Enjay Chemical Company, U.S.A.) and (b) the dimethylsulfonylhydrazone compound was replaced by 3-ethyl-2-benzothiazolinone aminosulfonylhydrazone represented by the formula:

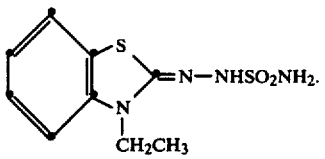

The 3-ethyl-2-benzothiazolinone aminosulfonylhydrazone was found to be more active than the dimethylsulfonylhydrazone compound of Example 1. A single pass of the photothermographic AgBrI film containing 3-ethyl-2-benzothiazolinone aminosulfonylhydrazone through the rollers at 100° C. followed by heating the laminate of the photothermographic AgBrI film with the PAC image receiving element for 5 to 30 seconds was found to be adequate to produce a neutral (black) image in the PAC image receiving element.

The following aminosulfonylhydrazones can be substituted for the sulfonylhydrazone of Example 2 to provide an image:

| Example No. | $R^4N—NHSO_2NH_2$ $R^4$ |
|---|---|
| 3 | 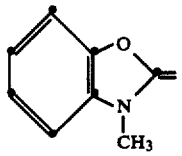 |
| 4 | 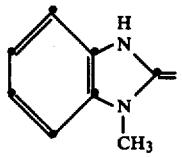 |
| 5 | 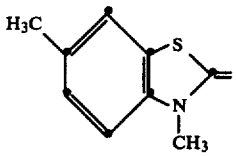 |
| 6 | 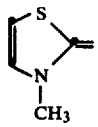 |

-continued

| Example No. | $R^4N—NHSO_2NH_2$ $R^4$ |
|---|---|
| 7 | 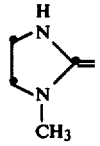 |
| 8 | 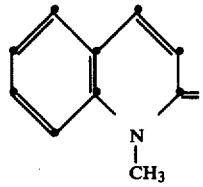 |
| 9 | 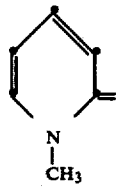 |
| 10 | 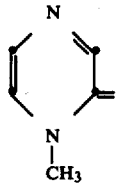 |
| 11 | 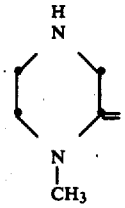 |
| 12 | 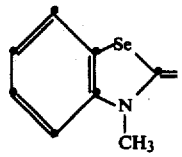 |
| 13 | 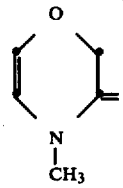 |
| 14 | 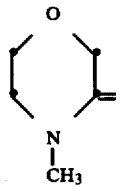 |

-continued

| Example No. | $R^4N—NHSO_2NH_2$ $R^4$ |
|---|---|
| 15 | 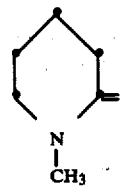 |
| 16 | 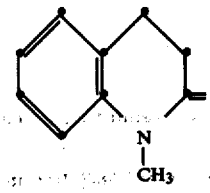 |
| 17 | 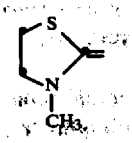 |
| 18 | 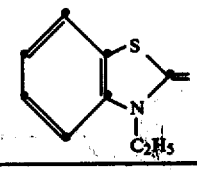 |

The invention has been described in detail with particular reference to preferred embodiments thereof, but it will be understood that variations and modifications can be effected within the spirit and scope of the invention.

What is claimed is:

1. In a photothermographic element comprising a support bearing, in reactive association, a photothermographic layer comprising photographic silver halide, a dye-forming coupler and a hydrazone reducing agent which, in its oxidized form, reacts with the dye-forming coupler, the improvements comprising the combination of (a) an ammonia or amine responsive imaging material, and (b) as said hydrazone reducing agent, an aminosulfonylhydrazone that is capable of developing an image in said photothermographic layer and that is capable of releasing an aminosulfinic acid which, in turn, thermally releases ammonia or an amine to generate an image in the ammonia or amine responsive imaging material.

2. A photothermographic element as in claim 1 wherein said aminosulfonylhydrazone is represented by the formula:

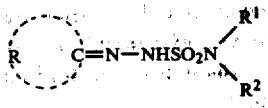

wherein R represents the atoms necessary to complete a nitrogen containing 5 or 6 member heterocyclic ring or a benzo substituted 5 or 6 member nitrogen containing heterocyclic ring; and $R^1$ and $R^2$ are individually hydrogen or alkyl containing 1 to 5 carbon atoms, or together are the atoms selected from the group consisting of carbon, hydrogen, oxygen and nitrogen atoms necessary to complete a 5 or 6 member heterocyclic ring.

3. A photothermographic element as in claim 1 wherein said aminosulfonylhydrazone is represented by the formula:

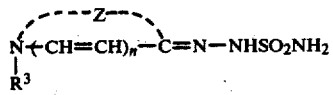

wherein $R^3$ is alkyl containing 1 to 5 carbon atoms or hydrogen; and

Z is the atoms necessary to complete a 5 or 6 member heterocyclic ring or a benzo substituted 5 or 6 member heterocyclic ring;

n is 0 or 1.

4. A photothermographic element as in claim 1 wherein said aminosulfonylhydrazone is represented by the formula:

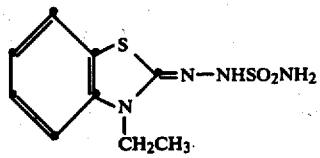

or

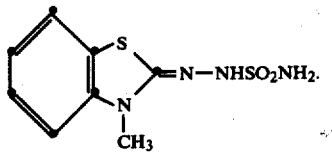

5. A photothermographic element as in claim 1 wherein said photothermographic layer comprises, in reactive association photographic silver halide, a dye-forming coupler and an oxidation-reduction image forming combination comprising (i) an organic silver salt oxidizing agent with (ii) a hydrazone reducing agent for said organic silver salt oxidizing agent.

6. A photothermographic element as in claim 1 wherein said photothermographic layer comprises, in reactive association, in a poly(vinylbutyral) binder photographic silver halide, a dye-forming coupler and an oxidation-reduction image forming combination comprising (i) an organic silver salt oxidizing agent consisting essentially of silver behenate, with (ii) said aminosulfonylhydrazone reducing agent.

7. A photothermographic element as in claim 1 wherein said ammonia responsive imaging material comprises an aromatic 1,2-dialdehyde capable of reacting with ammonia to form a dye.

8. A photothermographic element as in claim 1 wherein said ammonia responsive imaging material comprises o-phthalaldehyde capable of reacting with ammonia to form a dye.

9. A photothermographic element as in claim 1 wherein said ammonia responsive imaging material comprises a reducible cobalt (III) complex containing releasable amine ligands.

10. A photothermographic element as in claim 1 also comprising, in at least one operatively associated layer, an energy-activatable image precursor composition comprising at least one cobalt (III) complex having releasable ligands and an image-forming material that generates an image in response to the release of the ligands.

11. A photothermographic element as in claim 1 wherein said dye-forming coupler is a 2-pyrazolin-5-one dye-forming coupler.

12. In a photothermographic element comprising a support bearing a photothermographic layer (A) comprising in a polymeric binder, photographic silver halide, and an oxidation-reduction image forming combination comprising (i) an organic silver salt oxidizing agent consisting essentially of silver behenate, and (ii) a hydrazone reducing agent for said organic silver salt oxidizing agent, said hydrazone reducing agent in its oxidized form being capable of reacting with the dye-forming coupler, the improvement comprising the combination of (I) an ammonia responsive cobalt (III) complex imaging layer (B) comprising, in a binder, a cobalt (III) hexammine complex and o-phthalaldehyde, said layer (B) being in reactive association with said layer (A), and (II) as said hydrazone reducing agent, an aminosulfonylhydrazone represented by the formula:

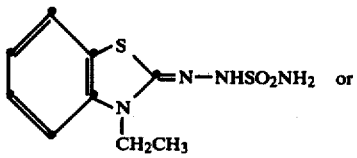

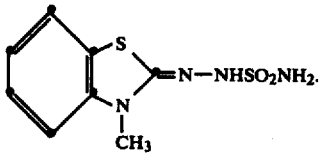

13. In a photothermographic composition comprising a photothermographic material comprising photographic silver halide, a dye-forming coupler and a hydrazone reducing agent which, in its oxidized form, reacts with the dye-forming coupler, the improvement comprising the combination of (I) an ammonia responsive imaging material, and (II) as said hydrazone reducing agent, an aminosulfonylhydrazone that is capable of developing an image in said photothermographic layer and that is capable of releasing an aminosulfinic acid which, in turn, thermally releases ammonia.

14. A photothermographic composition as in claim 13 wherein said aminosulfonylhydrazone is represented by the formula:

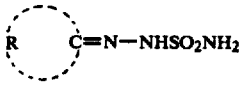

wherein R represents the atoms necessary to complete a nitrogen containing 5 or 6 member heterocyclic ring or a benzo substituted nitrogen containing 5 or 6 member heterocyclic ring.

15. A photothermographic composition as in claim 13 wherein said aminosulfonylhydrazone is represented by the formula:

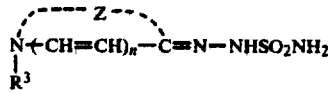

wherein $R^3$ is alkyl containing 1 to 5 carbon atoms or hydrogen; and

Z is the atoms necessary to complete a 5 or 6 member heterocyclic ring or a benzo substituted 5 or 6 member heterocyclic ring;

n is 0 or 1.

16. A photothermographic composition as in claim 13 wherein said aminosulfonylhydrazone is represented by the formula:

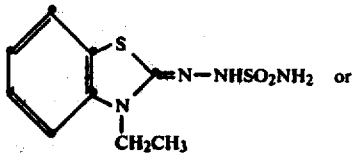

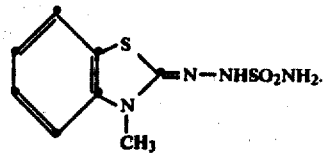

17. A photothermographic composition as in claim 13 comprising an aromatic 1,2-dialdehyde capable of reacting with ammonia to form a dye.

18. A photothermographic composition as in claim 13 comprising o-phthalaldehyde capable of reacting with ammonia to form a dye.

19. A photothermographic composition as in claim 13 comprising a reducible cobalt (III) complex containing releasable amine ligands.

20. A photothermographic composition as in claim 13 wherein said dye-forming coupler is a 2-pyrazolin-5-one dye-forming coupler.

21. A photothermographic composition comprising (a) photographic silver halide, (b) a dye-forming coupler consisting essentially of 3-methyl-1-phenyl-2-pyrazolin-5-one, (c) an oxidation-reduction image forming combination comprising (i) an organic silver salt oxidizing agent consisting essentially of silver behenate, and (ii) a hydrazone reducing agent consisting essentially of

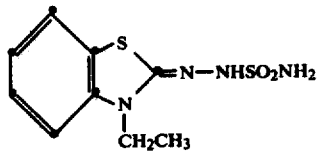

or

-continued

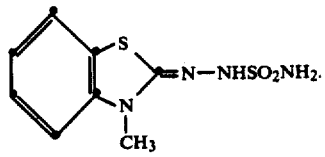

(c) a cobalt (III) hexammine complex, and (d) o-phthalaldehyde.

22. A process of developing an image in an exposed photothermographic element as defined in claim 1 comprising heating said element to a temperature within the range of about 100° C. to about 200° C. until said image is developed.

23. A process of developing an image in an exposed photothermographic element as defined in claim 12 comprising heating said element to a temperature within the range of about 100° C. to about 200° C. until said image is developed.

* * * * *